United States Patent [19]

Stukenberg

[11] 4,188,845

[45] Feb. 19, 1980

[54] STRIP CUTTER

[76] Inventor: Karl-Heinz Stukenberg, Maronenweg 10, D-3100 Celle-Gross Hehlen, Fed. Rep. of Germany

[21] Appl. No.: 891,529

[22] Filed: Mar. 30, 1978

[30] Foreign Application Priority Data

Apr. 4, 1977 [DE] Fed. Rep. of Germany ..... 2714962

[51] Int. Cl.[2] ..... B26D 1/28

[52] U.S. Cl. ..... 83/356.1; 83/356.3; 83/408; 83/913; 83/923

[58] Field of Search ..... 83/356.1, 356.3, 923, 83/913, 355, 411 A, 408

[56] References Cited

U.S. PATENT DOCUMENTS

| | | | |
|---|---|---|---|
| 438,845 | 10/1890 | Hine | 83/923 X |
| 1,764,202 | 6/1930 | Dreyfus | 83/355 |
| 1,797,950 | 3/1931 | Forman | 83/923 X |
| 2,217,766 | 10/1940 | Neff | 83/355 X |
| 2,251,312 | 8/1941 | Yoder | 83/923 X |
| 2,500,772 | 3/1950 | Reed | 83/355 X |
| 2,694,448 | 11/1954 | Petersen | 83/355 |
| 3,104,579 | 9/1963 | Blankenship et al. | 83/356.3 |
| 3,143,766 | 8/1964 | Rohn | 83/355 X |
| 3,650,485 | 3/1972 | Brokaw | 83/355 X |
| 4,009,629 | 3/1977 | Thomas, Jr. et al. | 83/355 |

*Primary Examiner*—Frank T. Yost

*Attorney, Agent, or Firm*—Smyth, Pavitt, Siegemund, Jones & Martella

[57] ABSTRACT

Strips cut by an edge trimmer are engaged by rollers pulling the strips through a pipe and permitting the strips to hang down and descent through a funnel towards a horizontally operating cutter comprised of an annular blade across which passes an excentrically rotating blade, to cut the strips into small pieces. The rotating portion of the cutter may include two blades, and the stationary part may have plural annular blades arranged around the axis of the rotation of the blades; different strips such as from different trimmers are fed to the annular blades, surrounded by separate funnels.

22 Claims, 4 Drawing Figures

STRIP CUTTER

BACKGROUND OF THE INVENTION

The present invention relates to shredding-by-cutting of strips which have been cut of webs upon trimming the edges of such web.

Webs of interest are, for example, plastic webs, foils, vlieses, or the like, which are usually made as a continuous sheet having rather irregular edges. Therefore, it is customary to trim such web along the edges not only for the sake of appearance but also to establish a particular width. As a consequence, a continuous strip of more or less irregular width is being cut from each of the edges of such a flexible material. The transport speed of such a web, for example, through the trimming station is often rather high, and the cut-off edge strips, one from each side, have to be removed in some fashion, for example, for disposal as waste or for purposes of recycling. The particular edge strips are, in fact, as continuous as is the web from which they are cut, and it is cumbersome and impractical to store or dispose of these strips in that configuration. This is particularly true if recycling is required as further processing will require some form of dividing the strips into smaller portions. Even disposing of the strips as waste will require some form of fragmentation.

The removal of the strips from the trimming machine and the fragmentation of the strips appears on its face to be a fairly simple problem; surprisingly significant problems have arisen in practice, which not have been satisfactorily resolved.

Generally speaking, it has been attempted to run the strips in some fashion away from the trimming device and to cut the strips into small pieces, for example, by means of a device which basically includes an annular opening and a cutting device that moves across that opening. It was found, however, that these known devices do not properly cut very thin plastic foils or foils having embedded or consisting of woven textile cloth-like materials. Also, it was found that running the strips from the trimmer to a central cutting station over long distances and introducing the strips into the cutting device, frequently incurs interferences, is rather noisy and not very reliable as to consistency as far as the fragmentation desired is concerned. Amazingly enough, it has been observed that certain principles in the mode of operation of such devices pose the problem and are directly responsible for the unsatisfactory operation, which in cases, may result in a complete stoppage of the entire production line.

One of these detrimental principles of the known equipment and method is to be seen in that the strips are in some fashion moved by means of air flow, and are introduced in that manner into the cutting station. It was found that particularly very thin and very flexible strips have the tendency to vibrate to a considerable extents, so that individual strips may bunch and snarl. Particularly if the tubular guide for such a strip is curved and other irregularities in the cross-section of such a guiding tube produce considerable turbulence. Snarling and twisting is also the more pronounced the greater the number of strips which are being moved through the same conduit. As the strips emerge from the guiding tube, an air flow becomes inherently irregular producing local turbulence and, again, snarling and twisting may prevent smooth entry of the strips into the cutting station. This may lead to snarls, looping, coiling or sticking in some location ahead of the cutter proper and the cutting, in effect, is interrupted, while continuously additional strip material is fed into the snarl. For some reason, a snarled bunch may thereafter be pushed or moved for other reasons into the cutting station, and due to its size may, in fact, block the cutter which ultimately may result in a breakdown of that device. Also, even small snarls will be unevenly cut, and do, in fact, load the cutter irregularly so that it wears faster and the noise developed is necessarily larger.

The moving of thin flexible strips through a pipe by means of air currents is also disadvantaged because, on the basis of the flow dynamics and the physics underlying the phenomena, strips may stick to the walls of such a tube, so that they may not even emerge therefrom. Snarling, back up and bunching in the tube, finally blocking the tube completely may completely interrupt the operation. Snarling and other interferences may also lead to tearing of strips.

It was further observed that, for example, in the case of certain plastics, the air flow accompanying the passage of such plastic strips through the tube resulted in electrical charges which, in turn, enhence the tendency for the strips to stick to the tube wall.

It can, thus, be seen that there are basic, inherent problems in moving the strips to the cutting station through a confined space and by means of air flow.

Another principle of operation of the known methods and systems, which pose disadvantages, is to be seen in the cutting of these strips, particularly into short clippings or cuttings by means of a cutter drum, having an axis of rotation which extends transversely to the direction of movement of the strips and cooperating with counter blades oriented parallel to that axis of rotation. The cutter drum produces an air flow on account of its rotation which is directed against the direction of movement of the strips, so that the latter, in fact, are blown away from the opening into which the strips to be cut are to be introduced. Therefore, the strips must be forced into that opening by means of a counteracting, stronger air flow. This, in turn, means that the entrance to the cutter is subjected to two oppositely directed air streams, resulting inherently in considerable turbulence thereat, tending to snarl the strips.

It was further found that such cutter drums oriented transversely to the direction of movement of the strips to be cut, do not really cut the strips by the usual shearing action but, in fact, the strip is chopped. This is due to the fact, that the blades of the drum cutter and the counter knife are for all practical purposes, almost parallel oriented so that the piece to be cut is engaged almost over its entire width and in an almost uniform manner, so that the shearing operation is not a true cutting but, in fact, a chopping operation. Furthermore, it has to be considered that the cutter drum mounted in bearings inherently has position tolerances so that the several blades, i.e. the movable ones and the stationary ones, move past each other without engaging but with a minute gap between them. This means that thin foil or textile strips may be wedged into the gap without being cut, chopped, or otherwise separated. Furthermore, it was found that these drum cutters are rather noisy.

The German printed patent Application, No. 2,100,713, discloses a cutter of the type outlined above and having the stated disadvantages. The device serves particularly for chopping strips resulting from trimming the edges of metal strip. Air moves the cut strip into a channel to be engaged by a rotating toothed tool and placed under tension to tear off at the end of the channel. This particular arrangement is disadvantaged on account of the air flow feeding as outlined above. Moreover, thin foils may not necessarily tear and be cut at the channel ends. Moreover, there is a gap between the channel and the teeth on the tool, so that a flexible strip, if very thin, may enter the gap without being cut, torn, or otherwise severed. For this reason, this particular tool can simply not be used for cutting thin flexible foil strips or strips containing textile fibers. Clearly, this particular publication does not suggest any remedy for these deficiencies.

The same can be said with regard to other publications describing methods and devices for removing and cutting strips resulting from edge trimming. By way of example, the German printed patent application, No. 1,561,707, describes such a cutter but does not disclose any means by means of which the strips can be moved from the trimmer to the strip cutter over a fairly long distance.

The U.S. Pat. No. 3,397,377 describes edge strips resulting from trimming multi-layer paper sheets. Rotating cutters are disposed directly underneath the trim cutters, in the same plane, and have an axis of rotation extending transversely to the direction of movement of the cut-off and trimmed-off strip; the rotating cutters cut the particular strips into small pieces. This is a more or less integrated kind of device.

The U.S. Pat. No. 3,536,273, discloses the transport of cut-off edge strips resulting from trimming of the edges of a plastic foil and under utilization of tubes; any further cutting of the cut-off strips is not described in this particular patent. The same is true with regard to the German printed patent application, No. 2,212,279, which discloses, in addition, the suction of textile strips away from the trimming equipment.

The German printed patent application, No. 1,253,033, likewise discloses removal of a cut-off edge strip by means of air flow and through a corresponding duct, but nothing is disclosed in this particular patent concerning the cutting of strips into small pieces.

The German Pat. No. 1,125,259, suggests moving cut-off edge strips through a pipe by means of an air flow towards a chopper. This chopper has cutting blades, whose axis of rotation extends transversely to the direction of movement of the strips.

DESCRIPTION OF THE INVENTION

It is an object of the present invention to avoid the deficiencies outlined above, and to provide a new method and equipment for cutting strips which have been cut from various kinds of webs, thin foils, etc., by an edge trimmer; and these edge strips are to be cut in a manner which ensures ready removal of the strips away from the trimmer to avoid interference; the strips are to be cut into small pieces without interruption, and at a rather low noise level.

In accordance with the present invention, it is suggested to engage the strips with drive means, such as rolls which run in synchronism with (possibly a little faster than) the edge trimmer cutting off these strips at a particular rate. The strips are permitted to bend down by gravity, just off the point of engagement by the rolls to descend towards an opening being preferably surrounded by a guiding funnel, and in which is mounted a curved blade, preferably an annular blade, cooperating with a vertically oriented blade rotating about a vertical axis, possibly being also driven in synchronism with the trimmer operation, to cut the descending strip or strips into small pieces. A relatively weak fluid flow in the guide funnel avoids sticking of the descending strip so that it may not bunch or coil.

One will preferably provide tubes to run the strip or strips from the edge trimmer or trimmers to the engaging rolls, whereby particularly all strips which are generated at the same speed, will be moved and cut together. The strips are being moved through the tubes by the rolls, in engagement therewith and without blowing. The two strips as cut from one web are preferably moved by a common drive roll cooperating with one of more pressure rolls, as the individual strips are preferably urged against the drive roll by individual pressure rolls, if they differ in thickness. Firm engagement of each strip is mandatory.

The strip cutter may be comprised of plural curved cutting blades, such as plural annuli arranged around the axis of rotation of the rotating blade. Each curved blade may be disposed at the bottom of a separate guide funnel, and the cuttings below may be separately collected from the different and, possibly, different types of strips on account of different types of webs and foils being trimmed concurrently. The guide funnels are preferably subjected to fluid flow to avoid sticking of the strips, but that flow must be directed to some extent in down direction to avoid that any upward movement be imparted upon the strip.

The rotating blade or blades (there are preferably two of the latter for reasons of dynamic balancing), are preferably adjustable so that their edges be located and move in a common plane, which is the same plane in which all stationary, curved cutting edges are located. The stationary blades are preferably inserts in a mounting plate, and are individually adjustable so that, indeed, all edges are in that plane of rotation, to ensure sliding engagement for true cutting.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIGS. 1 and 2 show a stand or frame 2 with a platform 3 which is accessible through stairs 1. This way, the apparatus to be described is mounted in an elevated position permitting placement of a large trash container 4 underneath for receiving the shredded web material. For reasons below, container 4 may be provided with separate compartments, as the cuttings it collects may have different consistency and one may want to collect them separately.

Figure 2:
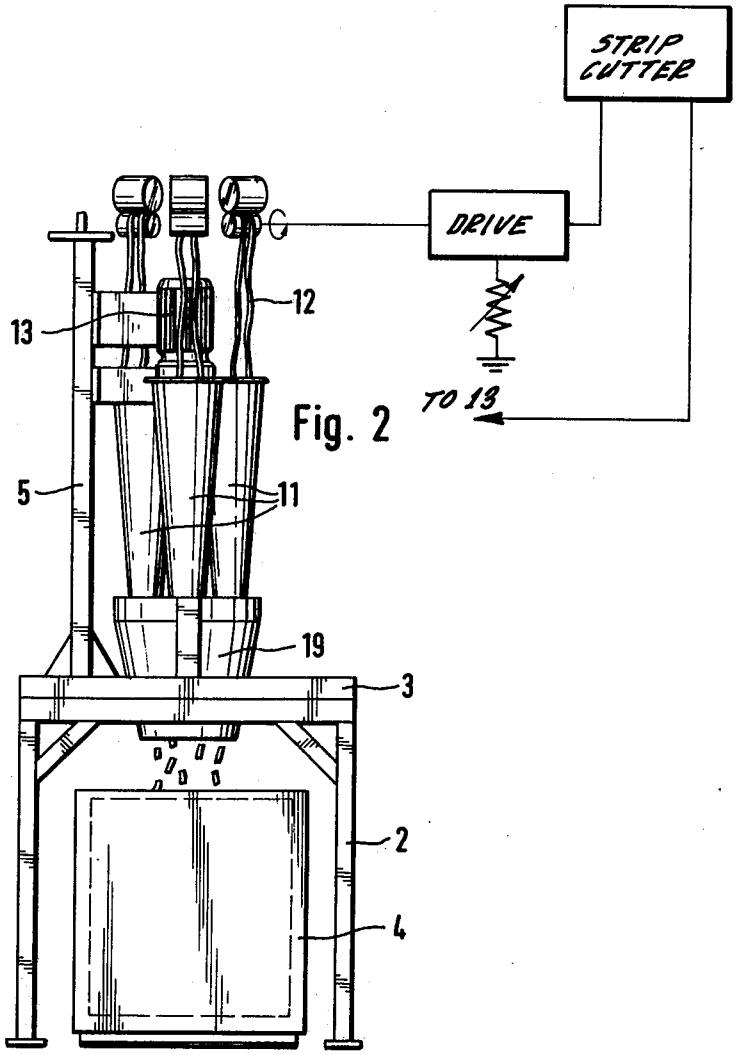
FIG. 2 is a side view of the apparatus shown in FIG. 1.
Figure 1:
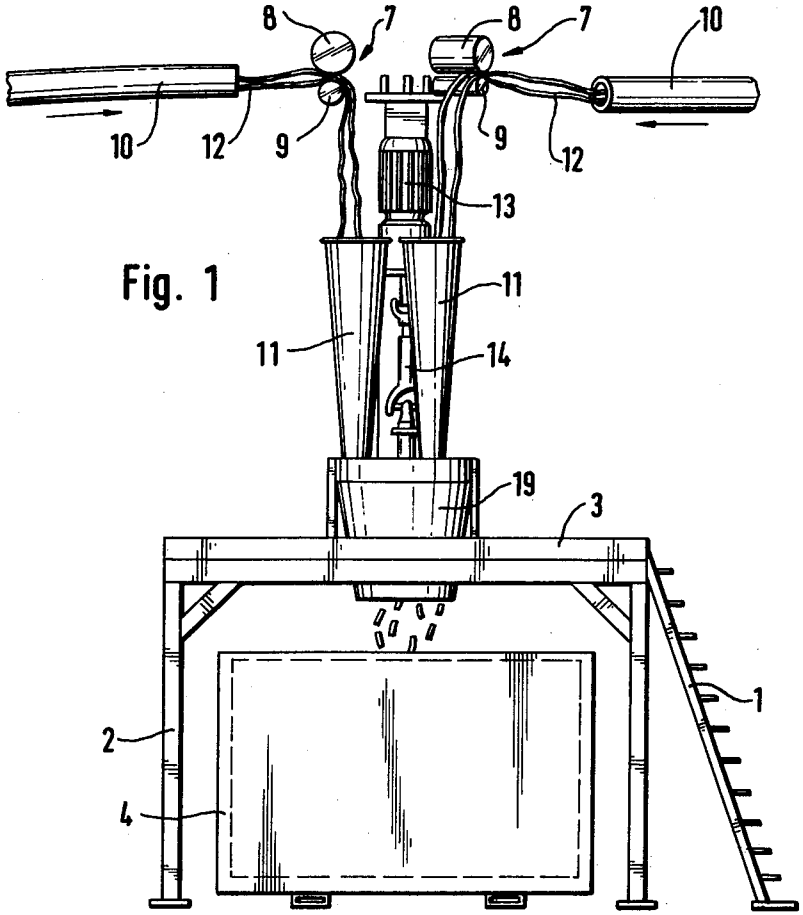
FIG. 1 is a front view of a cutting apparatus in accordance with the preferred embodiment of the present invention.

A vertical support or post 5 is mounted on and anchored to the platform 3. Bolts 6 are mounted on top of the post (see FIG. 6) for mounting withdrawal rolls 7 and suitable bearings for such rolls. These rolls 7 are arranged in pairs, and each pair includes a drive roll 8 and an upper pressure roll 9. They advance and pull strips running through tubes 10.

The strip material that arrives through the tubes 10 has been cut from the edges of webs by cutting or trimming device, not shown, and the two strips (one per edge of one web) are guided into one of the tubes 10. The particular apparatus shown cooperates, for example, with three different edge trimmers, and conceivably the webs being trimmed, may differ, i.e. there may be metal or plastic foil, paper webs, textile or cloth webs, textile fiber re-enforced webs, etc. The drive rolls 9 are controlled from the strip cutter, so that the speed of cutting and trimming these edge strips 12, is synchronized to the speed of the rolls 8. This way, these rolls withdraw the strips 12 and pull them through the tubes at exactly the speed of their generation. As the several trimmers may operate at different speeds, the individual drive rolls may be driven at different speeds accordingly. As further shown in FIG. 2, a potentiometer or the like may additionally be provided to manually adjust the roller speed.

The rolls 8, 9, in pairs, hold the strips taught, pull them through the tubes so that they do not twist, bunch, snarl, etc. The drawings show that two strips 12 (e.g. the strips as trimmed off opposite edges of a web) are advanced and moved by a roller pair 8, 9 in unison. Actually, all strips which originate at the same speed and are of the same material, can be moved in unison in this fashion. However, different edge strips may differ in thickness. In this case, it may be advisable to use different and differently adjusted pressure rolls 8, but a common drive roll to make sure that each strip is pulled at the same force; otherwise they may bunch, back up or misbehave.

The synchronization between strip pulling and strip production, i.e. web trimming, can be carried out by electrically slaving the roll drive or drives to the trimmer or by operating them in synchronism from a common master control, or by mechanically linking or gearing the respective shafts. The potentiometer or other fine adjustment of the roller drive speed permits compensation of length changes. For this reason, and particularly depending upon the elastic properties of the strips, one may have to adjust the roller speed to be a little higher than the edge strip production and trimmer speed. Also, as stated, the strips should be kept taught so that they will not twist on their way.

The rolls 7 run these strips 12 to permit their drooping or bending down by force of gravity and into funnels 11. These funnels serve as guide elements for all strips advanced in unison towards a cutter. Conceivably, a drive motor 13 is centrally disposed in the feed space occupied by strips 12 as they enter the funnels. The drive shaft proper of motor 13 is connected to a vertically oriented articulated shaft 14 which, in turn, is connected to a cutter 15 (see FIG. 3). The motor 13 is mounted on post 5.

Cutter 15 is supported and mounted underneath a plate 16. The cutter proper is comprised of a two-arm rotational blade holder 17, and two cutting blades 18 are secured to these arms. The blades are adjustably mounted to the arms for adjustment in height of the cutting edge, i.e. they are axially positionable as far as the axis of rotation of member 17 is concerned. The blades should also be easily removable for replacement after having worn. One needs to make the blades only of sufficiently strong material, the carrier 17 is not subjected to wear of cutting.

Mounting plate 16 is a stationary element and is secured to an exit funnel 19 which, in turn, is secured to platform 3 of stand 2. The plate 16 is provided with three openings 20, 21, 22. These openings are vertically aligned with the sets or pairs of rolls 8, 9, so that the strips hanging down from such a pair descend, in fact, towards such an opening 20, 21, or 22, as the case may be. The openings are, in fact, the bottom of the funnels 11 whose narrow ends respectively circumscribe these openings in plate 16 for guiding the strips down accordingly. The openings 20, 21, 22 are further arranged around a center which is traversed by the axis of rotation of blade holder 17.

Cutting annuli 23, 24 and 26 are respectively inserted in these openings 20, 21, 22. These annular cutting elements 23, 24 and 25 cooperate with the two blades 18 upon rotation of the latter. The annular blades 23, 24, 25 have cutting edges which project below the lower surface of plate 16, and are mounted in that plate 16 in a manner so that they may differ in vertical (axial) level. Adjustable and removable mounting of the individual blades 23, 24, 25 is also advantageous for reasons of easy replacement in the case of wear. The elevational adjustment of blades 23, etc., is chosen so that the blades 18, having the same axial level as to their cutting edges, move exactly along the cutting edges of the cutting annuli 23, 24, 25. In other words, the edges of blades 23, 24, 25 are adjusted to a common horizontal plane and the edges of blades 18 move in that plane. The blades 23, 24 and 25 are likewise made of strong durable material, the plate 16 can be made of cheaper material. Thus, uniform cutting conditions are provided for each of the three cutting stations and the respective edge strips 12.

The pieces cut have a length that depends on the rotational speed of the blades 18 in relation to the advancing speed of the strips 12 (and their generation). The latter speed (or speeds) is a given parameter and depends on the speed with which these strips are cut. Thus, adjustment of the speed of blades 18, i.e. of the speed of motor 13, determines the length of the pieces being cut. It may be convenient also here to slave the speed control for motor 13 to the speed of the cutters or at least of one of the cutters in the trimmer which cut strips 12.

The exit or discharge funnel 19 is provided with longitudinal partitions 26, 27, 28, so that each opening 20, 21, 22, is aligned with a separate disposal channel or chute 29, 30, 31, as respectively defined by the tri-partitioning of the funnel space. This way, one may collect separately the cuttings or clippings from the three webs whose edges were trimmed. As stated above, container 4 may be compartmentalized to permit separate collection.

Figure 3:
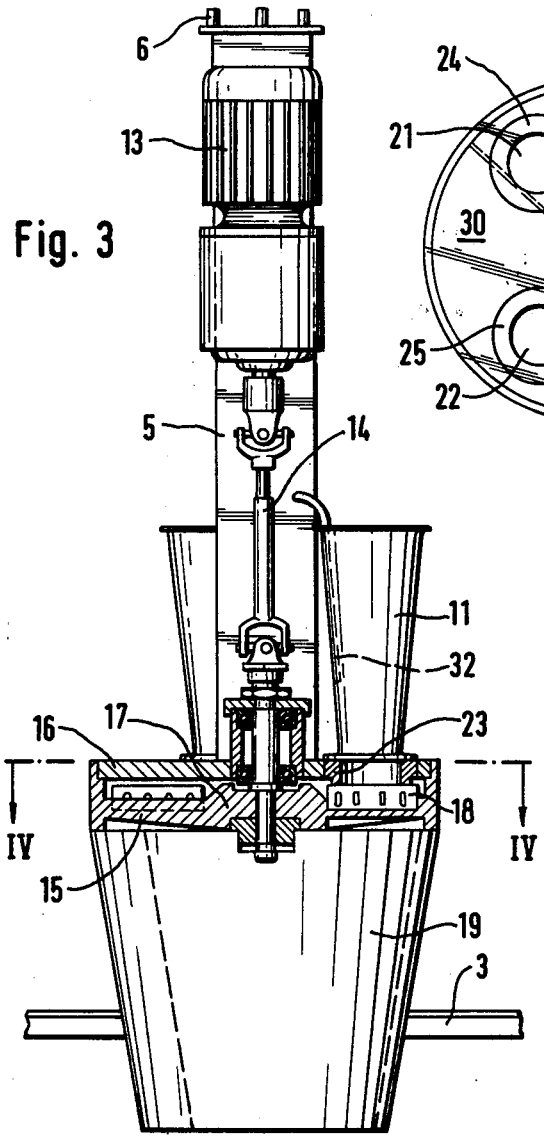
FIG. 3 is a view of a detail of the device shown in FIGS. 1 and 2, drawn to a larger scale, and showing the cutter proper.
Figure 4:
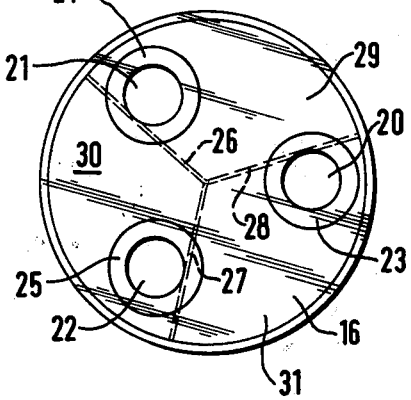
FIG. 4 is a horizontal section view taken along lines IV—IV in FIG. 3.

Each of the funnels 11 may be provided with a pneumatic conduit terminating in a nozzle 33 (see right-hand funnel 11 of FIG. 3). Air is blown through that nozzle in a direction towards the respective opening in plate 16 at the bottom of the respective funnel to avoid that any strip 12 may stick to the surface of the funnel but continues duly down towards the cutting blade. Instead of air, one may spray a liquid towards the funnel bottom to run also along the funnel wall preventing sticking of the strip material. In the case of air blowing, one merely needs to create a kind of cushion along the inner wall of funnels 11. In the case of water, one merely needs to create a sheath or film on the funnel wall. Either fluid will prevent sticking of the strips to the funnel.

The apparatus as described has a number of remarkable features which produce regular, continuous shredding type cuttings of the strip material as it arrives. First of all, it was found that the rotating blades 18 do not produce any upwardly directed air flow that may tend to blow the strip in upward direction. Thus, the strips 12 will not coil or bunch in the feed funnels 11. The new strip cutter differs also from the known ones in that the strips hang down and descend, i.e. move vertically, while the axis of rotation of the cutter is likewise vertically oriented. The blades 18 slide along the cutting edges of the annular blades 23, 24, 25, so that there is true cutting-by-shearing and no tearing or chopping. Thin strips or strips containing or consisting of fibrous textile material will not be wedged between the blades. Since the stationary cutting edges are curved (they do not have to be circular!), it is impossible that the cooperating blades engage a strip straight on, and simultaneously on both sides along registering lines. Rather, cutting occurs always at an angle and there are never corners into which strip material is being squeezed, as again, fibrous material could wedge and bunch under such circumstances.

Generally speaking, cutting results from cooperation of a straight movable blade edge with a stationary, curved blade, the curving may be circular or elliptical or otherwise, but the stationary, curved blades should not have any corners or other abrupt contour changes against which or by which the strip or strips could be bunched, squeezed or otherwise mishandled. Following cutting of a piece of a strip, the blade recedes and the opening of the annular blade is, in fact, open, so that the strip will, under its own weight, continue to descend until being caught by the blade 18 on the opposite arm. In each case, one will obtain a clean and neat cut. It is important also that the stationary annular blade edge is defined by a vertical cylindrical wall so that the ends of strips 12 cannot but descend down below the cutting plane; they will not get stuck. The cutting permits shredding (in the wide sense of the word) even very thin, very flexible strip material, including textile strips or fiber container strips. The cutter produces little noise and operates quite reliable.

Upon start up, one will thread a beginning length of strips into a tube 10 by means of wire or the like. If the tube 10 is rather long, one may use a movable plug-like element, fasten the strip material thereto and blow it through pneumatically. It is pointed out that the pneumatic threading is an initialization and preparatory step and blowing through the tubes 10 is not continued during regular operation.

It can readily be seen that the three stations which are incorporated in the illustrated apparatus, can be individually adjusted to the edge strip cutters and trimmers with which they cooperate. As stated, the illustrated electrical coupling of the drives may be replaced by mechanical ones. The three combined cutting stations as illustrated show the stationary cutting annuli in equal distances from the center of rotation. This ensures that each cutter loads the blades 18 equally, exhibiting the same lever arm.

The individual funnels 11 make sure that the several strips do not impede each other, nor will any ambient lateral air flow impede the regular descend of the strip material towards the respective cutter. The individual chutes in funnel 19 permit individual collections of the strip cuttings as they may consist of different materials and one may wish to recycle them, or some of them.

As outlined above, the guide surfaces (i.e. the inner walls of funnels 11) are subjected to a fluid flow (air, water) to prevent the strips from sticking to the wall and backing up, coiling, bunching etc. That flow, however, must be sufficiently weak so that the strips are not twisted. One needs merely an air cushion of fluid sheath along the funnel wall.

It can thus be seen that the novel strip cutter avoids the disadvantageous operational principles as outlined in the introduction. The invention is not limited to the embodiments described above but all changes and modifications thereof not constituting departures from the spirit and scope of the invention are intended to be included.

I claim:

1. Apparatus for cutting strips cut from edges of webs upon edge trimming of the webs, comprising:

means for grippingly engaging the cut strips and advancing them at the rate of strip cutting pursuant to the edge trimming, being he rate at which the strips arrive, said means for gripping, progressively releasing the cut strips so that the strips bend downwards freely under the force of gravity;

stationary means defining a horizontally oriented opening towards which the strip bends and descends;

a curved cutting edge mounted in the opening;

a cutting blade mounted for rotation about a vertical axis and for periodically passing the cutting edge for cutting the strips into small cuttings; and means for driving the cutting blade.

2. Apparatus as in claim 1, said means for engaging including at least one drive roll operatively coupled to the edge trimmer for synchronous operation therewith.

3. Apparatus as in claim 1, said drive means being operatively connected to the edge trimmer.

4. Apparatus as in claim 1, and including a guiding tube for orienting the strip or strips towards the means for engaging, the latter means pulling the strip or strips through the tube.

5. Apparatus as in claim 1, and including guide duct means above the openings.

6. Apparatus as in claim 5, said guide duct means being a funnel with a narrow end at the opening.

7. Apparatus as in claim 5, and including fluid means providing a flow along a surface of the guide duct means to prevent sticking of the strip.

8. Apparatus as in claim 1, said means for engaging including a drive roller and at least one pressure roller coacting with the drive roller.

9. Apparatus as in claim 8, said drive roller being driven in synchronism with said trimmer.

10. Apparatus as in claim 1, said means for engaging being driven in synchronism with the trimmer, there being means to adjust the speed of the means for engaging to advance the strip slightly faster than being produced by the trimmer.

11. Apparatus as in claim 1, said stationary cutting edge being circular.

12. Apparatus as in claim 1, said blade engaging said cutting edge during rotation, as the blade passes across the openings.

13. Apparatus for cutting strips into small pieces, the strips having been cut from edges of several different webs by means of several trimmers, comprising:

a stationary, horizontally positioned plate having a plurality of openings arranged around a center;

a plurality of curved cutting edges, respectively in the openings, and positioned in a common plane;

at least one cutting blade mounted for rotation on a vertical axis through said center, the blade having an edge moving in said plane;

plural means disposed above said plate for grippingly engaging said strips and moving them into points above said openings and in vertical alignment with said openings, at least one strip per opening, the means for gripping, progressively releasing them to permit them to freely descend by gravity towards the respective opening and to be cut upon trasversal of the opening.

14. Apparatus as in claim 13, annular cutting edges being defined by inserts adjustably mounted in said openings.

15. Apparatus as in claim 13, and including a two-arm holder with two cutting blades, respectively mounted on the arms, one of the two blades being said one cutting blade, the blades having edges moving in said plane.

16. Apparatus as in claim 15, said blades being adjustably mounted in said arms for trim adjustment of the edges in regard to said plane.

17. Apparatus as in claim 13, there being funnels mounted on said plane, having their respective narrow end aligned respectively with said openings.

18. Apparatus as in claim 17, said means for passing fluid along the respective inner walls of the funnels.

19. Apparatus as in claim 13, said curved blades having annular configuration.

20. Apparatus as in claim 13, said plural means being pairs of drive and pressure rollers.

21. Apparatus as in claim 13, including a vertical post, a motor on said post for driving said blade.

22. Apparatus as in claim 20, said plural means being mounted to the top of the post.

* * * * *